United States Patent [19]

Ambasz

[11] 4,046,422

[45] Sept. 6, 1977

[54] CHAIR

[75] Inventor: Emilio Ambasz, New York, N.Y.

[73] Assignee: Center for Design Research and Development N.V., Netherlands Antilles

[21] Appl. No.: 759,077

[22] Filed: Jan. 13, 1977

Related U.S. Application Data

[60] Division of Ser. No. 721,164, Sept. 7, 1976, which is a continuation-in-part of Ser. No. 586,794, June 13, 1975, abandoned.

[51] Int. Cl.[2] ..... A47C 15/00

[52] U.S. Cl. ..... 297/248

[58] Field of Search ..... 297/248, 249, 418

[56] References Cited

U.S. PATENT DOCUMENTS

D. 181,700 12/1957 Armitage ..... 297/418 X

FOREIGN PATENT DOCUMENTS 1,333,136 6/1963 France ..... 297/248

*Primary Examiner*—James C. Mitchell

*Attorney, Agent, or Firm*—Brumbaugh, Graves, Donohue & Raymond

[57] ABSTRACT

Optimal body weight distribution and excellent sacro-lumbar support are provided by a chair which changes configuration automatically to support the body in any sitting posture. The chair seat is mounted on a pair of laterally spaced-apart, elongated, substantially parallel seat supports disposed lengthwise of the chair, and the seat has sleeves that are received telescopically on the seat supports for sliding movement such that the seat slides forward and backward, relative to the chair back. The back tilts independently of the seat to conform to the sitting posture of a person sitting in the chair. The chair has arms that are shaped and dimensioned to interlock adjacent chairs for ganging.

8 Claims, 15 Drawing Figures

CHAIR

BACKGROUND OF THE INVENTION

This application is a division of U.S. patent application Ser. No. 721,164 filed Sept. 7, 1976, which is, in turn, a continuation-in-part of U.S. patent application Ser. No. 586,794 filed June 13, 1975, now abandoned.

In accordance with the invention of the inventor of the present invention described in U.S. Pat. No. 3,982,785 (issued Sept. 28, 1976), a substantial improvement in the comfort of chairs is afforded by mounting the seat so that it moves back and forth and assumes an increased rake, the further forward it is moved, and by mounting the back so that it pivots independently of the movement of the seat between upright and inclined positions. The chair described in that application thus allows one to assume various sitting postures, and the orientation of the seat and the back of the chair will conform to any of a variety of sitting postures to make the chair much more comfortable than a conventional chair of fixed geometry. The chair described in that application is also based on a modular concept of construction that allows the specific configuration to be varied widely by using a minimum number of changeable components in various combinations.

It is common practice to connect individual chairs to each other side by side in groups to provide orderly seating arrangements in auditoriums, meeting rooms, waiting rooms, and the like, and various ways of interconnecting the chairs have been proposed and used heretofore. For example, groups of chairs may be "ganged" by providing matching connector elements on the individual chairs or by mounting groups of chairs on common beams or other shared supports.

SUMMARY OF THE INVENTION

There is provided in accordance with the present invention a chair that is constructed to be used individually or to be ganged with matching chairs in a unique and interesting way. In particular, the chairs have armrests that are shaped and dimensioned for interengagement. The chair has a pair of armrests, one on each side, each of which is supported in cantilevered relation at one end from an armrest support in outwardly offset relation to the armrest support. The two armrests are at substantially the same vertical elevation, but the said one end of one of the armrests is located forward of the corresponding end of the other armrest such that when two matching chairs are ganged, adjacent armrests of the ganged chairs interlock laterally with the aforesaid one ends abutting back to front and the armrests themselves engaging each other inside to inside. One armrest is preferably shorter than the other such that the free ends (remote from the cantilevered support) substantially coincide. Among other preferred aspects of the armrest construction of the chairs, according to the present invention, are (1) the provision of components on each armrest that are interengageable with each other to restrain back and forth movement of one of the two ganged chairs relative to the other and (2) the provision of a connector between the interengaging armrests of ganged chairs, such connector being spaced some distance from the cantilevered connection between the armrests and the armrest supports.

A chair embodying the invention, in a preferred form, may have a movable seat and a pivotable back that is functionally equivalent to the chairs described in the patent referred to above in that the comfort of the chair is significantly greater than a conventional chair in a wide variety of sitting postures assumed by the user, but provides the functional features by way of unique and less costly structures. Accordingly, while the structure of the chairs of the present invention does not offer the advantage of the modular concept embodied in the prior chairs, it offers the advantages of economy and ease of manufacture, as well as offering alternative structural systems to the ones described in the prior application.

A chair according to the present invention thus preferably comprises a frame that includes at least one back support and a pair of laterally spaced-apart, elongated seat supports that extend parallel to each other and to the lengthwise axis of the chair. Each of the seat supports is of substantially uniform external cross section throughout its length. The chair seat has a pair of laterally spaced-apart, elongated sleeves, each of which receives one of the seat supports, and is of substantially uniform internal cross section along its length, such cross section being substantially complementary to the external cross section of the seat support with a clearance such that the seat is slidable forward and backward on the seat supports.

In chairs in which the seat has little or no padding, it is highly desirable to make the seat supports and the sleeves upwardly concavely arcuate (i.e., curved about a center of curvature located some distance vertically above the coincident axes of the respective sleeves and seat supports) so that the rake of the seat increases, the farther forward it is on the supports. In chair seats that are relatively heavily padded, the seat supports and sleeves need not be curved, inasmuch as the padding will provide comfortable support to a person sitting in the chair in all positions of forward and backward movement, even though the shifting of the seat to a more forward position, as the person leans back to a relaxed position in the chair, requires the imposition by the seat to the person of a greater horizontal force component so that the person does not have the feeling that he will slide off the seat. Heavy padding provides the necessary change in geometry that is present when curved sleeves and supports are used in lightly padded or unpadded seats.

Preferably, at least one resilient coupling is interconnected between the seat supports and the seat to urge the seat toward its rearwardmost position on the supporting structure. Interengageable parts on the seat and seat supports provide limits on the extent of forward and backward movement.

The back of the chair is mounted on the back support (or supports) for pivotal movement by pivoting or articulating coupling. For example, the back may have a socket (or sockets) which receives one part of a coupling on the back support; a second part of the coupling is suitably connected to the back support. An appropriate resilient system is associated with the pivoting or articulating coupling so that the back normally assumes a given position in the absence of the application of an external force to the back and so that the back provides some resistance to tilting; the back should, to be comfortable, resist tilting, so that the back of the sitter will be supported in a variety of sitting postures. The present invention provides several forms of articulating, resilient couplings for mounting a pivotable back on a pair of spaced-apart back supports.

In preferred embodiments, the back supports and seat supports are portions of a unitary frame member. For example, the chair may have two "L"-shaped frame members, the base leg of the L constituting the seat support and the vertical leg of the L constituting the back support.

Chairs embodying the present invention may also include a flexible, extensible tubular covering over the tubular frame members and connected at one end to the seat and at the other end to the back, such as by way of annular flanges associated with the sleeves on the seat and sockets on the back. The tubular covering flexes and extends and contracts in accordance with movements of the seat and back and permits mechanically effective structures to be used in connection with the movements of the seat and back, some of which might detract from the appearance of the chair without the coverings. The coverings also provide protection for the moving parts, particularly by keeping out dirt, and improve the comfort of the armrests of chairs that have them.

For a better understanding of the invention, reference may be made to the following description of exemplary embodiments, taken in conjunction with the figures of the accompanying drawings.

DESCRIPTION OF THE DRAWINGS

FIGS. 4A and 4B are side cross-sectional views showing one form of articulating connector by which the back is mounted on the back supports and showing the back in an upright and in a rearwardly tilted position, respectively;

DESCRIPTION OF THE EXEMPLARY EMBODIMENTS

Figure 1:
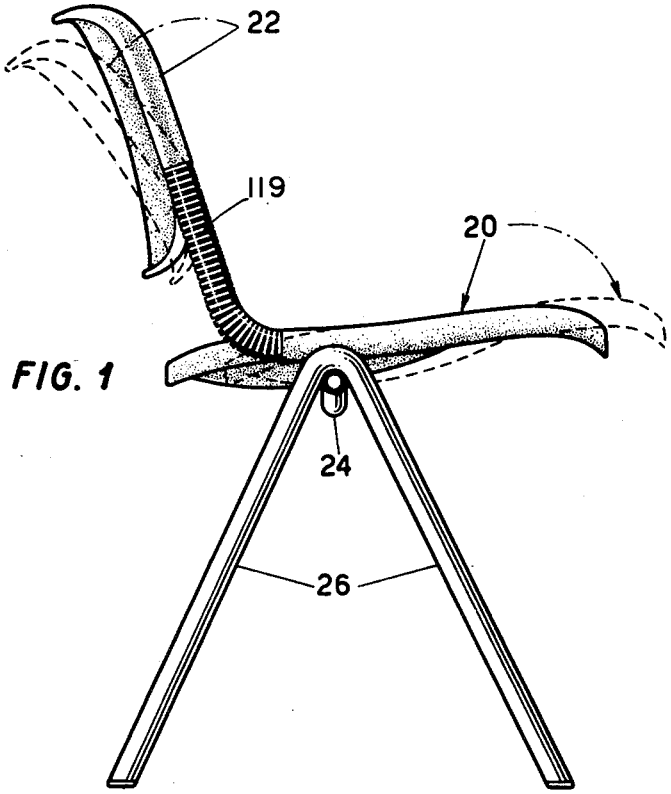
FIG. 1 is a side elevational view of one form of the seat and back structure of a chair, according to the invention, illustrating by solid lines one seat and back position and by phantom lines another position of the seat and back.
Figure 2:
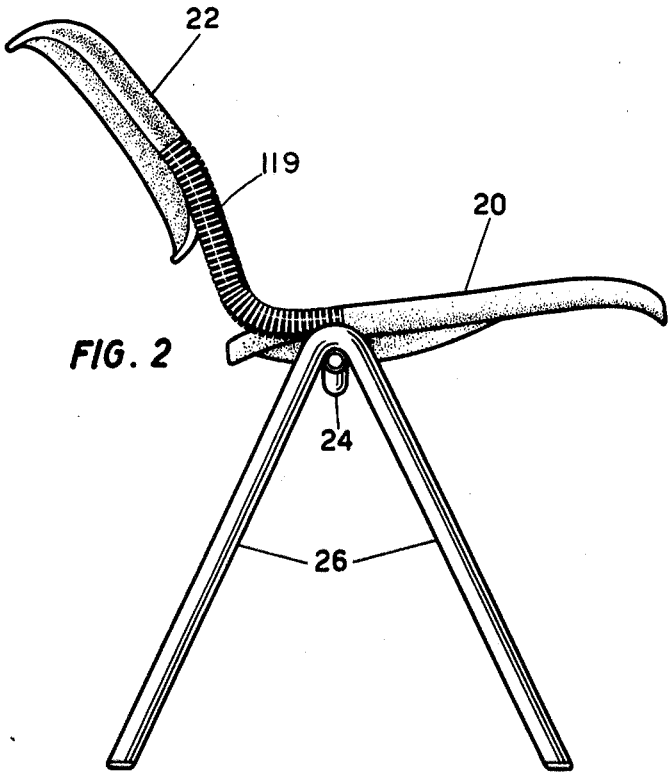
FIG. 2 is a side elevational view of the chair of FIG. 1 showing the seat in a forward and upwardly raked position and the back in a tilted position.

Referring to FIGS. 1 and 2 of the drawings, a chair of a preferred construction comprises a seat 20 that is movable between a rearward, relatively horizontal position, as shown in solid lines in FIG. 1, and a forward, relatively inclined or raked position, as shown in phantom lines in FIG. 1 and in solid lines in FIG. 2, and a back support 22 that tilts, independently of the position of the seat, between a relatively upright position as shown in solid lines in FIG. 1 and in inclined position as shown in phantom lines in FIG. 1 and in solid lines in FIG. 2. The details of the structures by which the seat and back are made movable are, of course, described in greater detail below. The chairs of FIGS. 1 and 2 includes laterally spaced-apart side members (not visible in FIGS. 1 and 2) that are generally L-shaped in side elevation, the bases of the L's providing supports for the seat and the vertical parts of the L's providing supports for the back. The side members are rigidly joined to a transverse beam-like member 24 that extends under the seat, and inverted "V"-shaped legs 26 are joined near the ends of the transverse member 24. The side members, transverse member and legs are preferably made of steel or aluminum tubing and are welded into a rigid, composite frame.

The seat 20 of the chair, as shown in FIGS. 1 and 2, has a sleeve 34 located on the under side and at each side. Each sleeve 34 receives telescopically a seat support 36 that is part of the chair frame. The seat supports 36 extend parallel to each other and to the lengthwise axis of the chair, and each is of uniform external cross section throughout its length. The sleeves 34 are also parallel, and each is of uniform internal cross section. The internal cross section of each sleeve matches with a small clearance the external cross section of the seat support such that the sleeves are slidable on the seat supports so that the seat moves forward and backward.

Figure 3A:
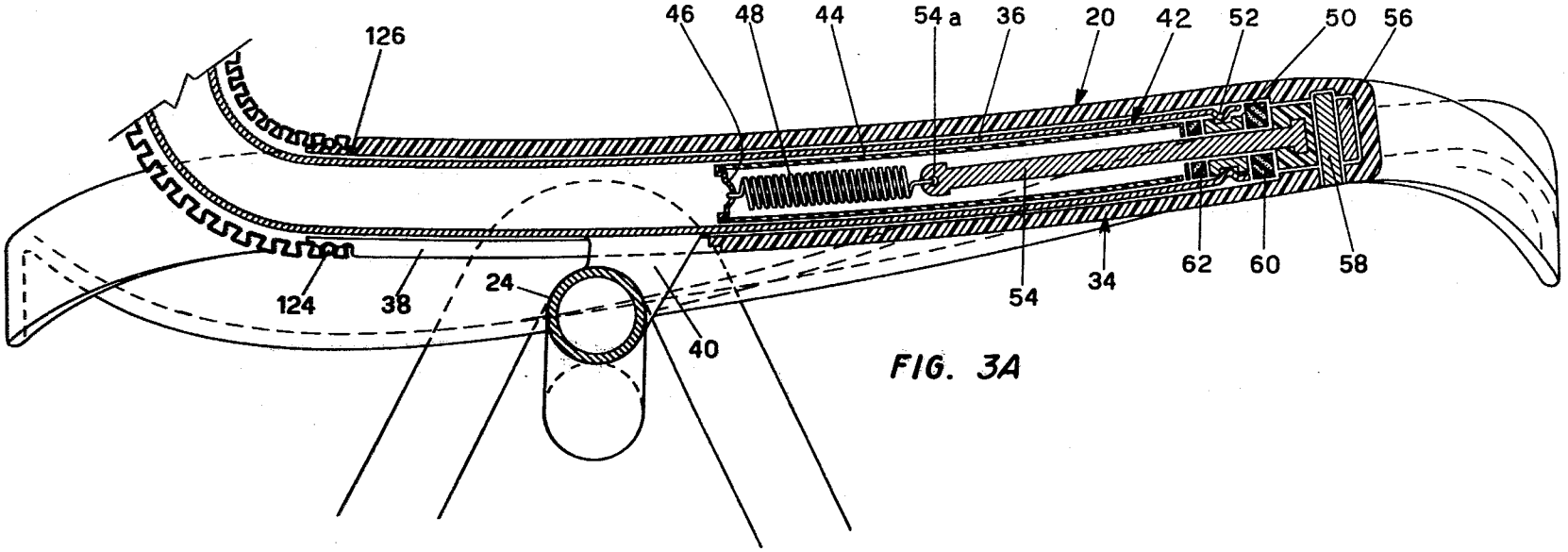
FIGS. 3A and 3B are views in side cross section showing the details of the mounting of the seat on the seat supports as it appears in the rearwardmost and forwardmost positions, respectively.
Figure 3B:
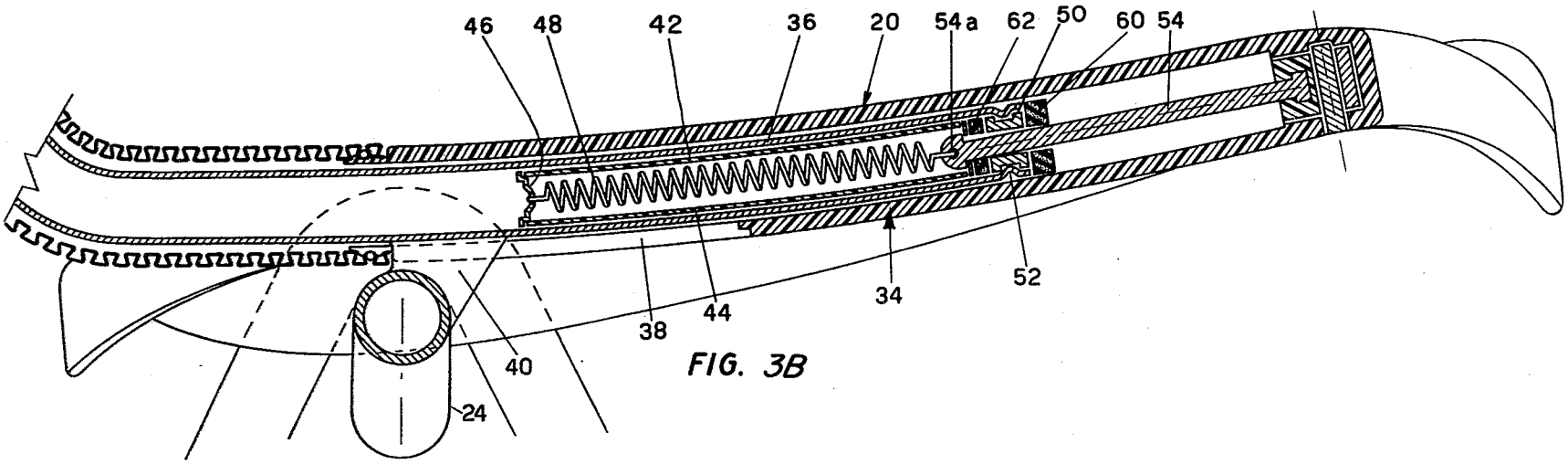

In chair seats having little or no padding, such as the seat shown in FIGS. 3A and 3B, the seat supports 36 and sleeves 34 have axes forming an upwardly concave circular arc that defines a vertical plane; in other words, the axis of each sleeve and seat support is a curve of uniform radius having its center vertically above the axis. Thus, as the seat slides forward and backward on the seat supports, its rake changes, the rake being increased the farther forward the seat slides. In chairs having heavily padded seats, the sleeves and seat supports need not be curved, because the padding compensates for the lack of curvature by accommodating the sitting posture of the person sitting in the chair.

As is apparent from a comparison of the two positions of the seat on the seat support shown in FIGS. 3A and 3B, the degree or range of change in rake of the seat as it moves forward and back is a function of the curvature of the coincident axes of the seat support 36 and the sleeve 34 and may, of course, be selected with a view to providing the desired change as a matter of comfort to the user.

Because the sleeves 34 of the seat 20 in the chairs are located under the top of the seat at the side edges, they constitute a dependent structure that imparts substantial strength and rigidity to the seat. In addition, the underside of the seat may be suitably reinforced by ribs or webs. Both the seat and back are preferably formed of a high-impact strength plastic, although other materials may, of course, be used, and the seat and back may be upholstered and lightly or heavily padded (as mentioned above).

As is best seen in FIG. 3A, a longitudinal slot 38 is provided in the back part of the bottom of each sleeve 34 to permit the reception within the back of the sleeve of a mounting bracket 40 that joins each of the side frame members to the transverse member 24.

The rearwardmost and forwardmost positions of the seat are established by suitable stops which, preferably, as in the illustrated embodiments, are associated with a spring return mechanism that urges the seat to its rearwardmost position on the support. As shown in FIGS. 3A and 3B, one form of spring return and stop mechanism (designated generally by the reference numeral 42) comprises a tubular spring holder 44 having an end wall 46 to which a coil spring 48 is attached. The spring holder 44 is inserted through the front end of the seat support 36 and is retained in the seat support 36 by a crimped connection 52. A link 54 is connected between the spring 48, which is under tension, and a connector 56 that is received in the forward end of the sleeve 34 and fastened in place by a retainer pin 58. The spring return mechanism 42, including the connector 56, is an assembly which, during construction of the chair, is installed in each seat support 36 prior to mounting the seat 20. To install the seat, all that is required is to slide it onto the seat support into the rearwardmost position and insert the retaining pin 58 through a hole in the bottom of the forward end of the sleeve 34; the pin may be glued in place, or it may be threaded to be retained in a threaded hole in the connector 56.

The rearward stop position of the seat on the seat support is established by engagement of the forward end of the seat support 36 with the forward end of the sleeve 34, preferably with an elastomeric bumper 60 interposed to cushion impact, should the seat be permitted to return rapidly from a forward position to the rearwardmost position. The forward stop position is established by engagement of an enlarged head **54*a* on the link with an elastomeric bumper or cushion 62 positioned adjacent the retainer 50 of the spring return of mechanism 42 (FIG. 3B**).

Figure 5:
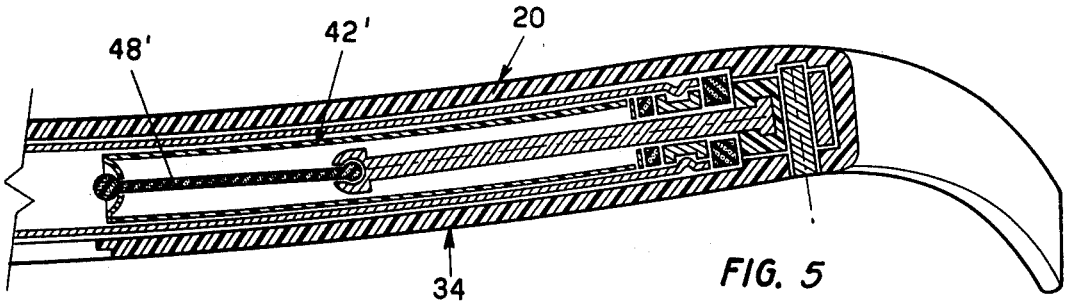
FIG. 5 is a side view in cross section of an alternative form of resilient coupling and limit stop arrangement between the seat and a seat support.

FIG. 5 of the drawings shows, as a modification of the spring return mechanism of FIGS. 3A and 3B, the substitution for the coil spring 48 of a resilient extensible strand or band 48'. Otherwise, the mechanism 42' of FIG. 5 is the same as that of FIGS. 3A and 3B. In general, mechanical spring return devices will be the least expensive and most effective types of spring return devices for use in the chair, but it will be apparent to those skilled in the art that other types, such as pneumatic types, may readily be substituted for the spring return devices shown in FIGS. 3A, 3B and 5 of the drawings.

Figure 4A:
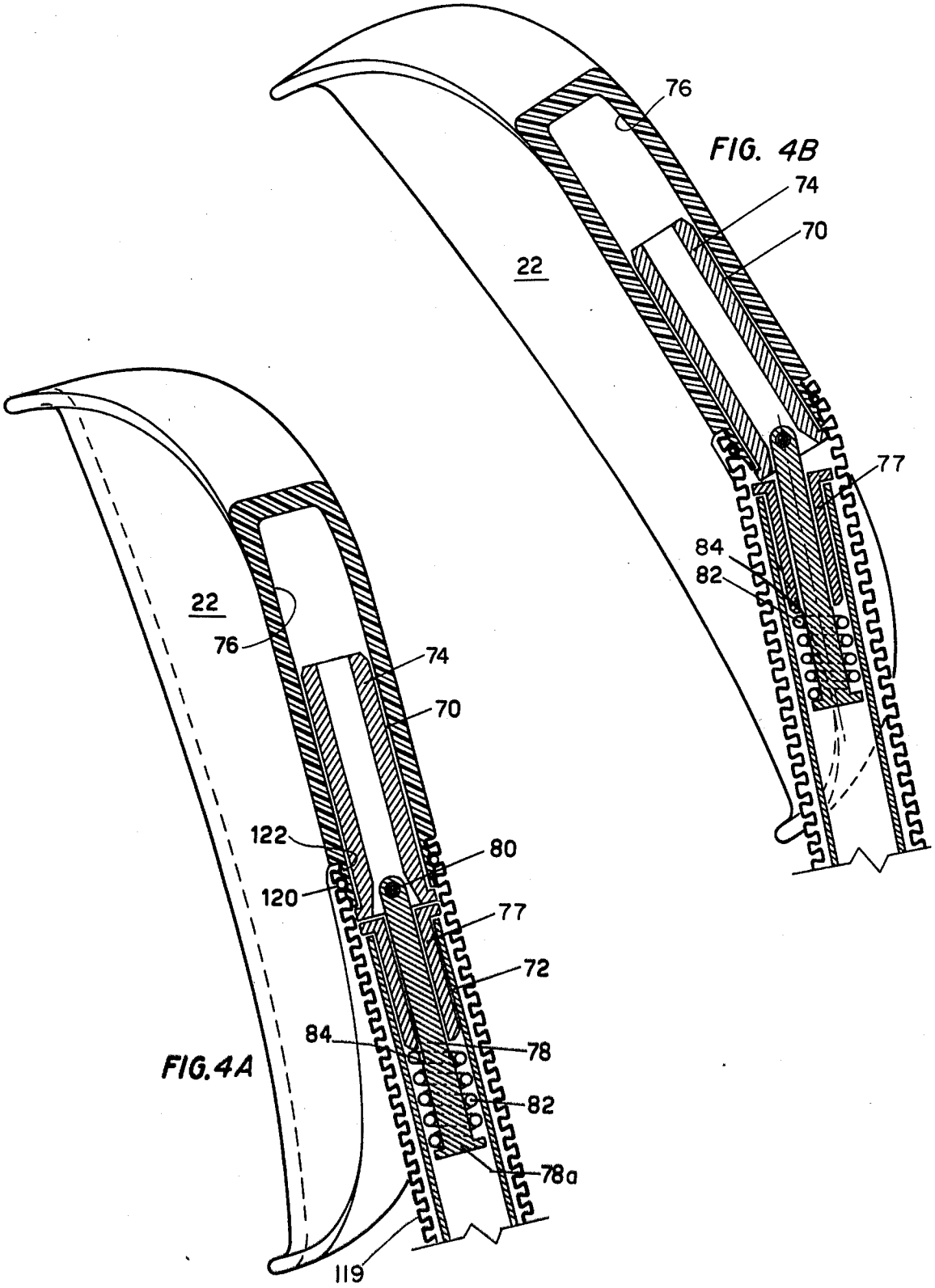

FIGS. 4A and 4B illustrate the details of one form of a resilient articulating connector 70 for mounting the back of the chair 22 on the back supports 72. Each back support 72 is constituted by the upper end portion of the tubing that is bent to form the generally L-shaped side frame member of the chair or an equivalent member. The back 22 is connected by the connector 70 to the upper end of each of the two back supports 72 by reception of an upper part 74 of the connector in a socket 76 provided at each end of the back.

The resilient, articulating connector shown in FIGS. 4A and 4B comprises a lower tubular part 77 that is received and glued, welded, crimped or otherwise secured in place in the upper end of the back support 72. A link 78 extends through the lower part 77, is connected at its upper end by a pivot pin 80 to the upper part 74, and receives a coil spring 82 held under compression between a flange **78*a* at the lower end of the link 78 and the bottom end of the lower part 77. Thus, the spring 78 draws the abutting, annular faces of the upper and lower parts of the connector into engagement and, as shown in FIG. 4A**, tends to hold the connector straight and urge the back into a generally upright position.

The forces imposed on the chair back, such as the forces exerted by the back of one sitting in the chair against the chair back, will control the tilt of the back. For example, FIG. 4B illustrates a rearward tilting of the chair back to a position it would tend to assume when a person sitting in a chair is sitting in a somewhat reclined position. The connector 70 allows the back to move to different orientations as a result of forces imposed on the chair back by increased compression of the spring 82 and a rocking of the upper parts 74 of the connector along the back edge of the upper end of the lower part 77. The back may assume any of an infinite number of positions, relative to the back support 72, as determined by the position of the back of the person sitting in the chair; thus, the back may also tilt forward rather than backward. The limit positions of tilting of the back may be established by designing the spring 82 to become fully compressed at some point, thereby restricting further tilting of the back. Alternatively, as in the embodiment shown in FIGS. 4A and 4B, a shoulder 84 can be provided on the link 78 in a position to engage the lower end of the lower part 77 of the connector at some predetermined position (see FIG. 4B), thereby preventing the link from moving up any farther and limiting further tilting of the back.

The seat back may be made of various materials, such as cast, molded or stamped metal or high-impact strength plastic. Both the seat and the back may be provided with cushions, upholstered or otherwise given a desired surface treatment.

Figure 6:
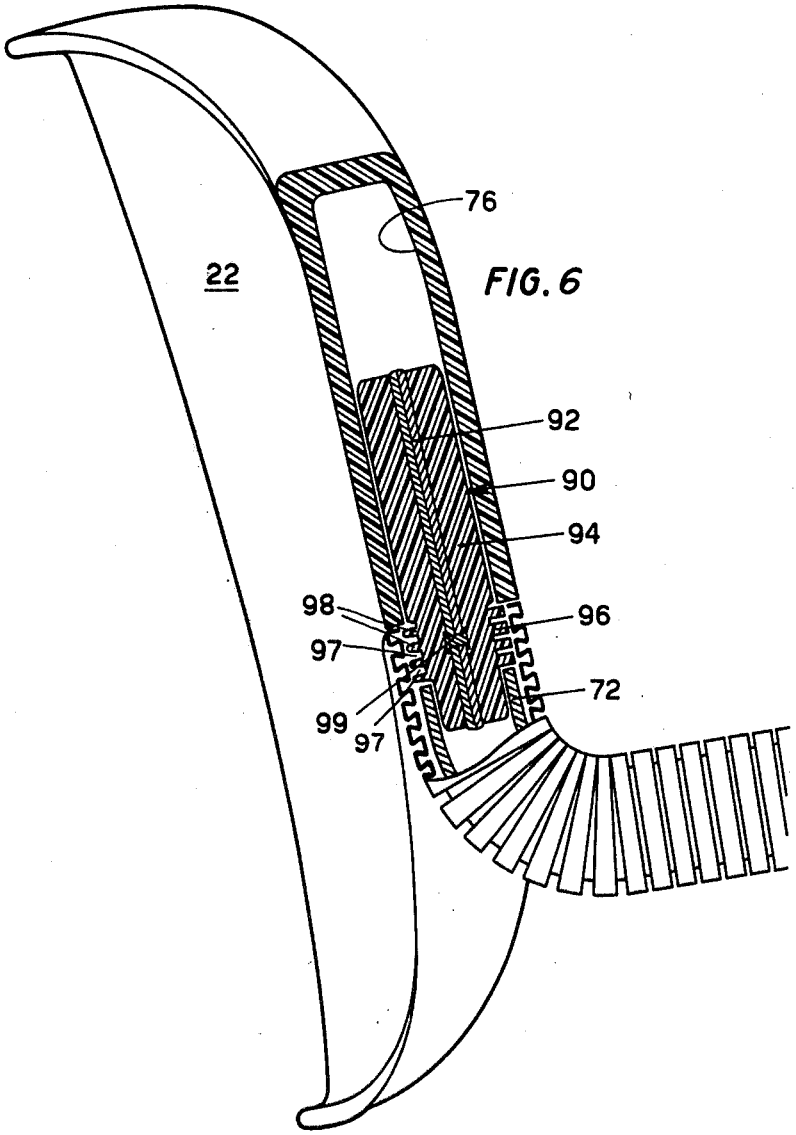
FIG. 6 is a side view in cross section showing an alternative form of resilient, articulating connector for mounting the back on the back support.

Various alternative constructions may be used for the resilient articulating connector between the back and the back support. For example, as shown in FIG. 6, another form of connector 90 comprises one or more leaf springs 92 molded into a flexible plastic or rubber casing 94, the upper end of which is received and secured in the socket 76 in the seat back and the lower end of which is received and secured in the upper end of the seat support. The extent of tilting in both forward and rearward direction is controlled by providing an enlarged portion 96 on the casing 94 and forming grooves 97 of predetermined widths in the enlarged portion of such dimensions and shapes that when the casing is bent, the ribs 98 defined by the grooves 97 engage each other and become clamped between the upper end of the seat support 72 and the lower edge of the socket 76, thereby preventing additional flexure of the casing 94. Although one leaf spring is workable, a stack of springs joined together, such as by a rivet 99, is preferred.

Figure 7A:
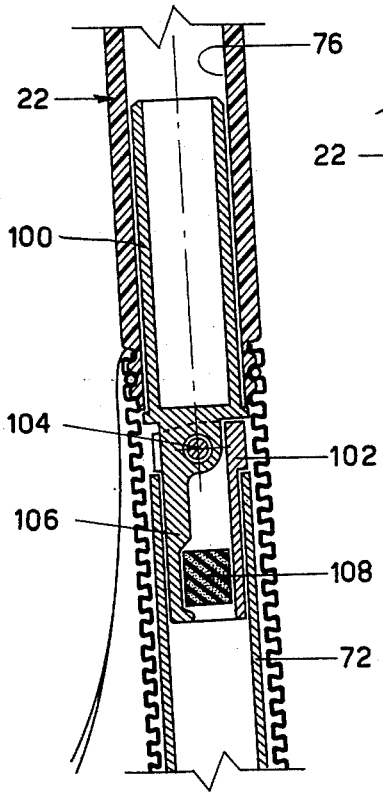
FIGS. 7A and 7B are side views in cross section of another resilient, articulating connector for mounting the back on a back support and showing, respectively, an upright and a tilted position of the back.
Figure 7B:
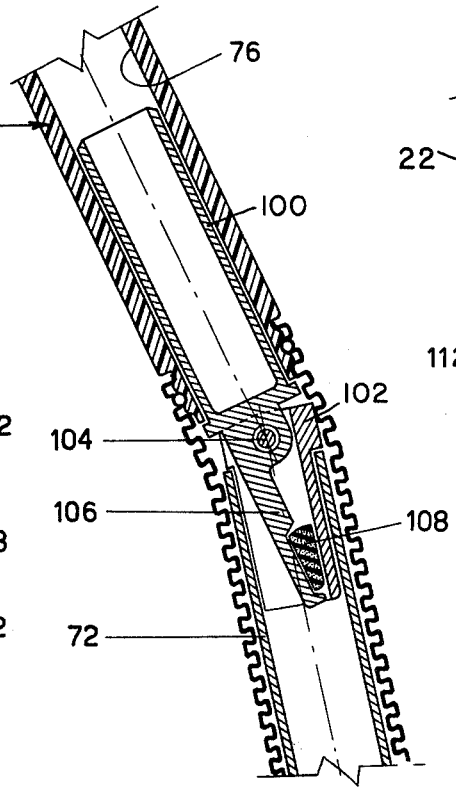

The resilient articulating coupling shown in FIGS. 7A and 7B comprises an upper part 100 received in the socket 76 of the chair back and a lower part 102 received in the end of the back support 72. The upper and lower parts 100 and 102 are connected to each other for articulation by a pivot pin 104, and a lever arm 106 on the upper part extends down into the lower part. A body 108 of a resiliently compressible material is received between the lever arm 106 and the wall of the lower part 102. As shown in FIG. 7B, the connector allows the back to tilt rearwardly under an external force imposed on it, thereby compressing the body 108. In the absence of an external force on the back 102, the compressible body resiles and restores the back to the upright position, as shown in FIG. 7A.

Figure 8:
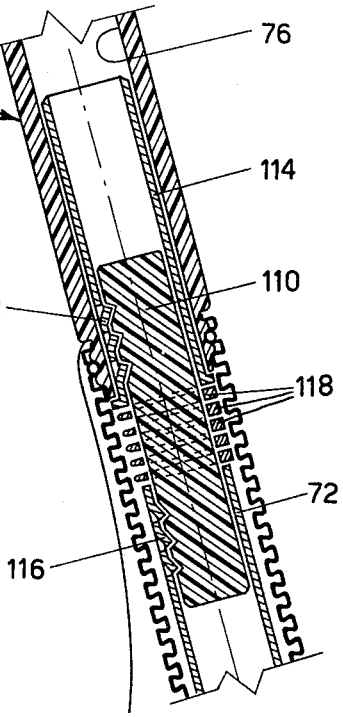
FIG. 8 is a side cross-sectional view of another resilient, articulating connector for mounting the back on a back support.

Another form of connector for mounting the chair back on the back supports, as shown in FIG. 8, consists of a rod 110 of an inherently resilient material, such as rubber, the upper end of which is secured, such as by crimping 112, in a casing 114 that is fastened, such as by gluing, in the socket 76 of the seat back, and the lower end of which is secured, such as by crimping 116, in the upper end of the back support 72. The extent of bending permitted by the connector 110 is limited by a stack of tapered non-compressible rings 118 interposed between the upper end of the back support 72 and the lower end of the tubing 114. A force imposed on the back results in flexure of the connector, and the inherent resiliency of the material will restore the seat back to its upright position upon release of the force.

Referring to FIGS. 1, 2 and 9 to 11 of the drawings, the otherwise exposed portions of each of the side frame members between the seat and the back and parts of the connectors are concealed, protected, and given a pleasing appearance by a covering in the form of an extensible and flexible tubing 119, one end of which is attached, such as by a split resilient clamp ring 120 (see FIGS. 4A and 4B), to an annular flange 122 at the lower end of the socket 76 of the chair back 22 and the other end of which is attached, such as by another split resilient clamp ring 124 (see FIGS. 3A and 3B), to an annular flange 126 at the rearward end of the sleeve 34 on the seat. The tubing 119 may be any form of resilient extensible flexible tubing material cut to an appropriate length. For example, a corrugated or plain rubber tubing, corrugated or plain extensible spring-wire reinforced spiral tubing, or tubing constituted by a multiplicity of closely spaced rings interconnected by webs and formed of a flexible, preferably resilient material, may be used as the covering for the frame members.

Although it is generally preferable to provide a separate spring return for the seat, such as one of the spring return mechanisms shown in FIGS. 3A, 3B and 5, to restore the seat to its rearward position in the absence of a force tending to move it away from the rearward position, an elastic covering connected to the seat at one end and either to the back or to some point remote from the seat at the other end can provide the function of restoring the seat to the rearward position, a separate spring return mechanism being omitted in such instances.

Figure 9:
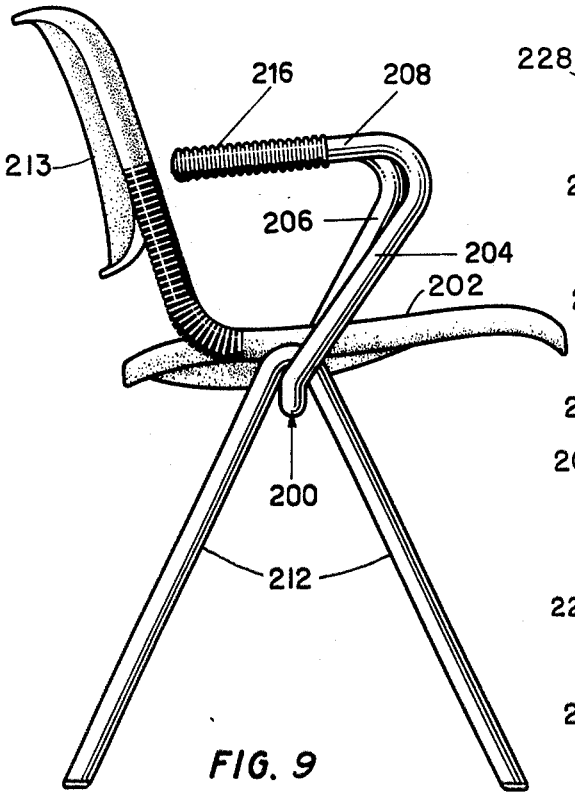
FIG. 9 is a side elevational view of the complete chair embodying the present invention.
Figure 10:
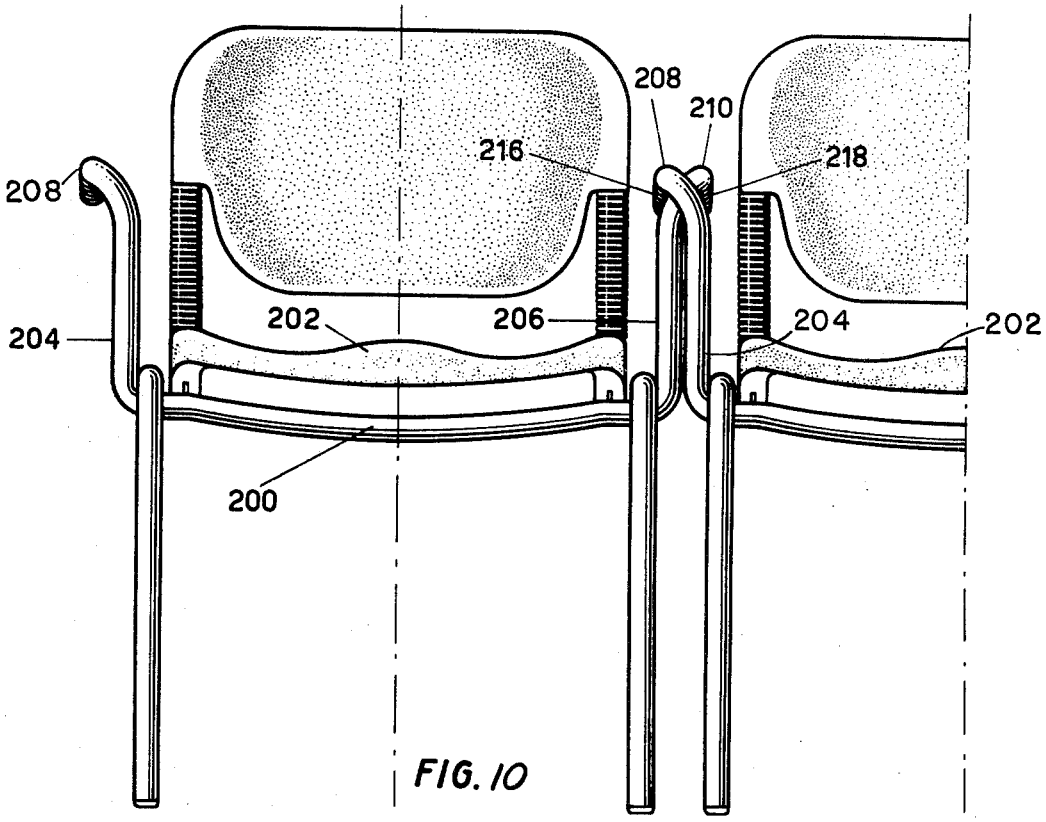
FIGS. 10 and 11 are front and top views, respectively, of two chairs of FIG. 9, ganged side by side, only part of one of the chairs being shown.
Figure 11:
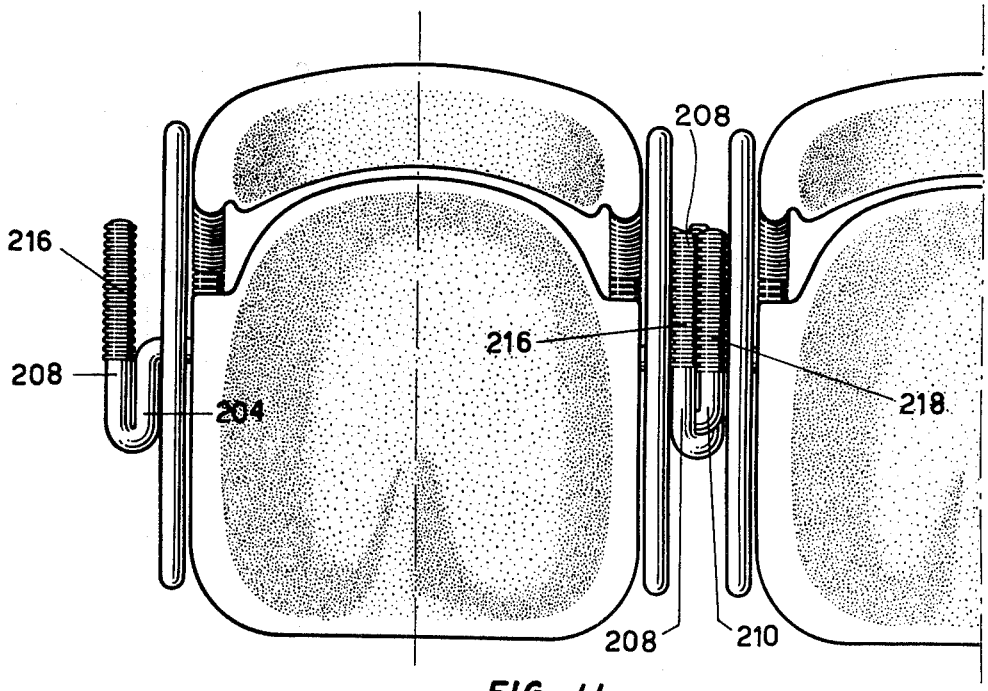

FIGS. 9 to 11 of the drawings illustrate the complete chair having legs, a seat and a back constructed in a manner substantially the same as the chair shown in FIGS. 1 and 2 and embodying one or the other of the various alternative components described herein and shown in the other figures of the drawings but, in addition, having, according to the present invention, a special form of arm structure that permits the chairs easily and quickly to be ganged side by side and to be held together firmly and securely by means of interlocking between the arms. In the embodiment shown in FIGS. 9 to 11, the arms are integral extensions of a transverse frame member 200 (see also member 24 of FIGS. 1 and 2) that extends under the seat 202, turns upwardly and forwardly at each end to provide armrest supports 204 and 206 at opposite sides of the chair and then is bent rearwardly and outwardly at each end to form a juncture with a pair of armrests 208 and 210. The legs 212, seat 202 and back 213 are substantially identical to the corresponding parts of the chair shown in FIGS. 1 and 2 and described hereinabove.

It will be observed by considering FIGS. 9, 10 and 11 together that the armrest support 204 is bent forward slightly more than the support 206 such that the curved portion at its upper end at the juncture between it and the armrest 208 is located somewhat forward of the juncture between the armrest support 206 and the armrest 210. As FIG. 11 best illustrates, the objective is to have the juncture between the armrest 210 and its support 206 located relative to the juncture between the armrest 208 and its support 204 such that the two junctures of the armrests of adjacent ganged chairs interengage front to back. In addition, both armrests 208 and 210 are displaced outwardly from their respective supports by a distance substantially equal to the thickness of the armrest, so that, as can be seen in FIGS. 10 and 11, the armrests of the two adjacent ganged chairs interengage inside to inside. In other words, the geometric configurations of the two armrests of a single chair are such that several chairs can be ganged together side by side with their armrests in engagement inside to inside and with the junctures between the armrests and the armrest supports engaging front to back.

The interengagement of the armrests, as described above and shown in the drawings, keeps adjacent chairs from moving laterally away from each other, but does not completely prevent the possibility of one moving backward relative to the other or from a degree of pivoting about a vertical axis generally in the area of the interengagement zones between the junctures. Thus, it is preferable to provide interlocking between the chairs to prevent them from moving back and forth relative to each other and from pivoting slightly relative to each other. The first of those functions is fulfilled by the provision of arm covers 216 and 218, each of which is composed of a series of spaced-apart rings 220 or 222 interconnected in closely-spaced relation by narrow webs 224 or 226, the cover preferably being molded from a suitable substantially rigid plastic. The armrest covers are shown in detail in FIG. 12 in conjunction with the armrests of two adjacent chairs interlocked in the way shown in FIGS. 10 and 11.

Figure 12:
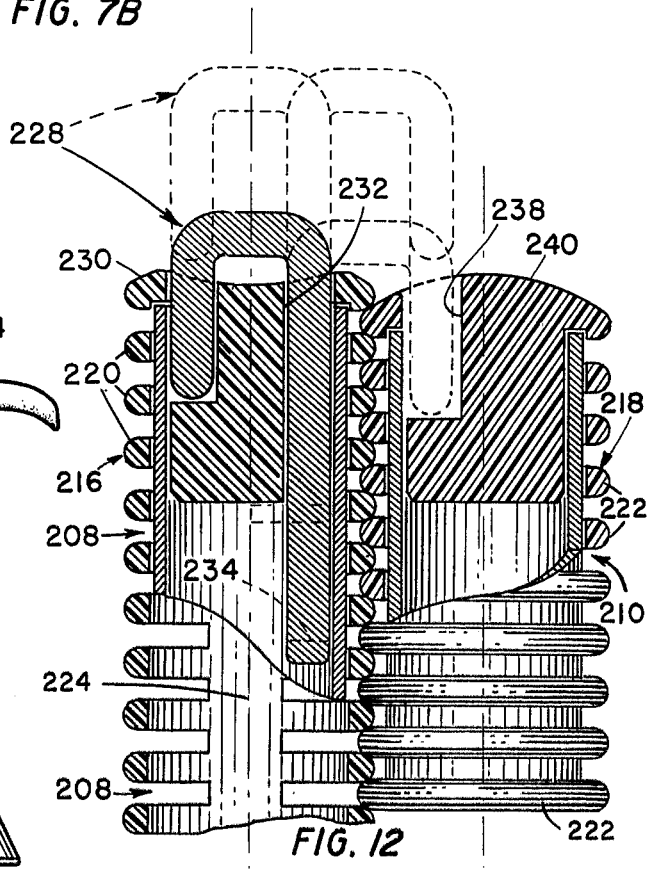
FIG. 12 is a detail view in cross section of a connector for joining the free ends of adjacent arms of the ganged chairs of FIGS. 9 to 11.

More particularly, as shown in FIG. 12, a cover 216 associated with one armrest 208 is mounted on the armrest 208 such that its rings 220 will nest between the rings 222 of the cover 218 on the other armrest 210, thereby providing an interfitting relationship that prevents a chair in ganged relation with another from sliding backward and forward.

The possibility of one chair pivoting relative to the other around the area of interengagement of the junctures between the armrests and the armrest supports is prevented by a hook 228 (FIG. 12) installed in a cap portion 230 of the armrest cover 216. The hook in the exemplary embodiment shown in the drawings is generally "J"-shaped, the longer leg extending through a hole 232 in the cap portion 230 and having a retainer flange or lug 234 that keeps it from being pulled entirely out of the cap portion by engagement with the inside face of the cap portion. For use of the chair separate from other chairs, the J-shaped hook 228 is kept in a position shown in solid lines in FIG. 12 in which a shorter leg is received in another hole 236 in the cap portion 230. As indicated by the dotted lines in FIG. 12, the hook is pulled out from the cap 230 and rotated through 180° and then pushed in so that the shorter leg is received in a hole 238 provided in an end cap portion 240 of the cover 218 of the other arm 210 of a pair of interengaging or interlocking armrests of adjacent ganged chairs.

Although the embodiments described above in detail and shown in the drawings include the feature of independent forward and backward movement of the seat and tilting of the back, which features are highly desirable and advantageous, it will be understood that the concept of the present invention of interengaging arms that permit chairs to be ganged can be readily used in chairs that have fixed seats and backs. Moreover, various structural arrangements for connecting the arm supports to the legs and other frame members of the chair can be substituted for the unitary arms, arm supports and transverse member of the embodiments of FIGS. 10 to 12. Thus, the above-described embodiments of the invention are intended to be merely exemplary and numerous variations and modifications may be made without departing from the spirit and scope of the invention. All such variatons and modifications are intended to be included within the scope of the invention as defined in the appended claims.

I claim:

1. A chair adapted to be ganged in coupled relation side by side with similar chairs comprising a seat, a back and a pair of armrests, each armrest being supported in cantilevered relation at one end from an armrest support in outwardly offset relation to the armrest support, the two armrests being at substantially the same vertical elevation and said one end of one of the armrests being located forward of said one end of the other armrest such that when two such chairs are ganged, adjacent armrests of the ganged chairs interlock laterally with said one ends abutting back to front and the armrests engaging inside to inside.

2. A chair according to claim 1, wherein one armrest is shorter than the other such that the free ends of adjacent armrests of two ganged chairs substantially coincide.

3. A chair according to claim 1 and further comprising components on each armrest that are interengageable with each other to restrain back and forth movement of one of two ganged chairs relative to the other.

4. A chair according to claim 3, wherein the components of each armrest include at least two outwardly projecting spaced-apart rings.

5. A chair according to claim 3, wherein the component of each armrest is a sleeve extending over a substantial portion of a length of the armrest and composed of a series of spaced-apart rings interconnected to each other by integral webs, and wherein the sleeves on the two armrests are positioned thereon such that the rings on one armrest are engaged in the spaces between the rings on the other armrest of an adjacent ganged chair.

6. A chair according to claim 1 and further comprising means spaced a substantial distance from the junctures between the armrest supports and the armrests for connecting the ganged chairs to each other independently of the interengagement of the armrests.

7. A chair according to claim 6, wherein the connector means is a hook mounted on one armrest and selectively engageable with the other armrest of an adjacent ganged chair.

8. A chair according to claim 7, wherein the armrests are tubular members and wherein the hook is received telescopically in the free end of one armrest and is movable between a position in which it is substantially entirely received within that armrest and a position in which a portion is received within the free end of the other armrest.

* * * * *